United States Patent [19]

Duerr

[11] Patent Number: 4,782,870

[45] Date of Patent: Nov. 8, 1988

[54] PORTABLE WOOD SPLITTER

[76] Inventor: Dennis Duerr, Rte. 1, Box 144, E. 12122 Day Mt. Spokane Rd., Mead, Wash. 99021

[21] Appl. No.: 116,072

[22] Filed: Oct. 30, 1987

[51] Int. Cl.[4] ..... B27L 7/00

[52] U.S. Cl. ..... 144/193 A; 144/193 R; 144/366

[58] Field of Search ..... 144/3 K, 193 R, 193 A, 144/366

[56] References Cited

U.S. PATENT DOCUMENTS

| | | | |
|---|---|---|---|
| Re. 13,221 | 3/1911 | Power | 144/193 R |
| 2,851,072 | 9/1958 | Gerjets et al. . | |
| 3,799,295 | 12/1973 | Blasbaugh . | |
| 4,275,779 | 6/1981 | Rowe . | |
| 4,444,231 | 4/1984 | Dillion . | |
| 4,503,894 | 3/1985 | Gratowski | 144/193 A |
| 4,520,854 | 6/1985 | May | 144/193 A |
| 4,700,759 | 10/1987 | Duerr . | |

OTHER PUBLICATIONS

Publication: advertisement, Vermeer Manufacturing Company, "LS-100 Log Splitter", Pella, Iowa 50219.

Publication: advertisement, Duerr Inc., Jul. 1, 1985.

Publication: advertisement, Vermeer Manufacturing Company, "LS-50 Log Splitter", Pella, Iowa 50219.

*Primary Examiner*—W. Donald Bray

*Attorney, Agent, or Firm*—Wells, St. John & Roberts

[57] ABSTRACT

A portable wood splitter is disclosed having a splitter frame adjustably mounted to a support frame. In one embodiment the support frame is wheel supported and in another embodiment the support frame is mountable to a vehicle such as a tractor for transport. The splitter includes a splitter beam with a blade mounting slide plate powered to move toward and away from a platform at a lower beam end. The slide plate includes safety features to avoid finger injury. A double gib adjustment on the slide plate facilitates adjustment for wear and enables centering adjustments of the blade on the beam. The beam is mounted to the support frame by a clamp arrangement that will facilitate selective longitudinal adjustment of the beam relative to the frame. The beam is pivotal, on the first embodiment between a horizontal position overlying a towing tongue and an upright position. An adjustment feature enables re-positioning of the towing tongue from its horizontal operative position to an upright compact condition where an end of the tongue engages the ground surface to stabilize the unit.

17 Claims, 6 Drawing Sheets

PORTABLE WOOD SPLITTER

TECHNICAL FIELD

The present invention relates to wood splitting apparatus and more particularly to apparatus that is attachable to a vehicle for transport.

BACKGROUND OF THE INVENTION

Powered wood splitters are very useful to ease the burdensome task of splitting large quantities of firewood blocks. Many different forms of powered wood splitters have been developed. Perhaps the most useful design involves a frame-mounted blade and platform arrangement wherein the blade, platform, or both are driven toward and away from one another by action of a hydraulic cylinder. A wood block is placed between the blade and platform and the cylinder is activated to move the blade and platform together relative to one another thereby driving the blade through the wood block.

It is advantageous that the blade and platform be oriented for relative movement in a vertical plane for convenience in loading and operation. Many splitters have therefore been developed with splitting frames that may be selectively moved between horizontal and vertical positions. Most are operable in the horizontal position which also represents a transport position to facilitate transport of the splitter from one location to another. The vertical position is utilized primarily for operation of the splitter to ease positioning of the wood blocks without requiring excessive manual lifting.

Splitters having the ability to pivot the splitting mechanism between horizontal and substantially vertical positions have the advantages indicated above but also include several disadvantages. Firstly, this form of splitter while very functional in operation is typically difficult to store. Such splitters require a large floor space due to the forward projecting towing tongue utilized for transport purposes.

As an attempted solution to the above problem, several splitters have been developed wherein the towing tongue is incorporated directly with the splitter frame. The towing tongue pivots upwardly with the splitting frame to minimize the floor space occupied when the splitter is to be stored. However, integration of the towing tongue and splitter frame results in stability difficulty in operation and handling difficulty when the device is to be moved from the horizontal to vertical orientation. The latter difficulty stems from the wheel support usually provided for this type of splitter. Efforts to elevate the splitter frame from a horizontal to a vertical orientation will typically result in rolling motion of the support wheels away from the lifting force. There is also a potential that the wheels will "kick out" when the frame is to be moved from the vertical to the horizontal orientation.

As an attempted solution to the above problem, splitters have been developed wherein the splitting frame has been pivoted separately from a towing tongue permanently mounted to the frame. The towing tongue provided additional stability by means of a downnwardly positionable foot toward the outward end of the tongue. The difficulty with this arrangement is as indicated above where storage of the unit becomes difficult due to the forward-projecting towing tongue.

Another difficulty realized with portable splitters having pivoted splitting frames is stability in rough terrain. Prior splitters (especially those having integrated splitting frames and towing tongues) become very unstable in uneven terrain. This is due to the lack of positive ground contact by the wheels and the bottom end of the splitter frame. It is not unusual that only two point contact is made where high or low contours are encountered along the ground surface. This results in dangerous instability.

The above problem has been realized to the extent that some manufacturers will provide expensive and relatively complicated bracing arrangements to secure the splitters in their upright operational orientations. While such bracing may effect additional stability, considerable expense is added to the splitter, additional time is consumed in readying the splitter for operation, and additional variables are added to the functioning of the machine which affect its safe operation.

From the above, it may be understood that there remains a need for a portable wood splitter that is stable in operation and in which storage space for the splitter is minimized without compromising stability. There is further need for such a splitter that is simple in construction and that is inexpensive to produce and easy to set up and operate.

BRIEF DESCRIPTION OF THE DRAWINGS

Preferred embodiments of the invention are illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of sciences and useful arts" (Article 1, Section 8).

Figure 8:
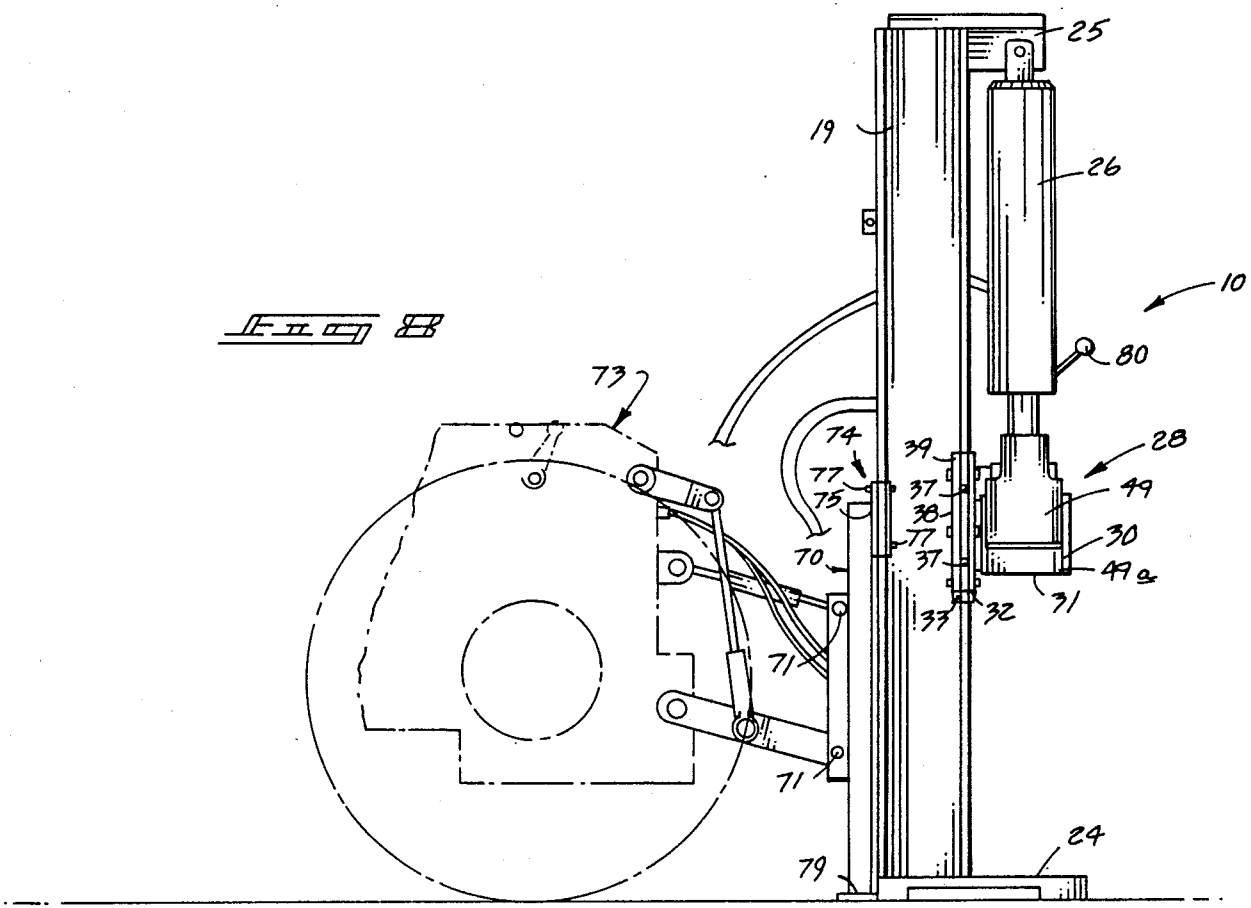
FIG. 8 is a side elevation view of an embodiment of the present invention for attachment to vehicles such as tractors.

Two examples of the present splitter are illustrated in the accompanying drawings. A first form of the present splitter 10 is shown in FIGS. 1–7 as a portable splitter for attachment to vehicles such as conventional automobiles and trucks. The embodiment illustrated in FIG. 8 is intended for attachment to other vehicles such as tractors. Detailed description will be given for the embodiment illustrated in FIGS. 1–5 followed by a description of the embodiment exemplified in FIG. 8. Features identical to both embodiments will be referred to with like reference numerals, since both include common features, especially in the splitter framework.

The first embodiment splitter includes generally, a wheeled frame 12 comprised of a transverse frame member 13 supporting a pair of axles 14 with wheels 15 rotatably mounted thereto. A towing tongue 16 extends longitudinally (with respect to the direction of towing travel) from the frame member 13.

A splitter frame 18 is mounted to the wheeled frame 12. It generally includes an elongated beam 19 extending from a first or top end 20 to a second or bottom end 21. The beam includes substantially parallel side edges 23 extending between ends 20, 21.

A platform member 24 and a blade member 30 are mounted on the splitter frame 18. The members 24 and 30 are mounted for movement relative to one another along the length of the frame between open positions in which a block of wood may be received between the blade and platform, and closed positions adjacent one another. In the closed positions at least one of the members has been driven toward the other to split the previously positioned block of wood.

In the embodiment shown, the blade 30 and platform 24 are arranged on the splitter frame so the blade is movable toward and away from the platform. As shown in the present drawings, the platform is affixed to the beam 19 at the bottom end 21 and is stationary relative to the blade. It should be understood that similar arrangements could also be made within the scope of this application. For example the blade and platform could be movably supported on the frame for movement toward and away from one another. The blade could also be mounted to the frame in a stationary position with the platform movably supported on the beam for movement toward and away from the blade. The blade-platform arrangement illustrated is preferable for simplicity in manufacture and to minimize costs and maintenance.

The blade 30 is mounted as part of a splitter head 28 with a sharp edge 31 oriented for movement along the beam 19 toward and away form the platform 24. The splitter head 28 may include a slide plate 29 with the blade 30 attached thereto.

The side plate 29 includes a beveled surface 32 adjacent a blade edge 31 and substantially facing the platform 24. The beveled surface 32 leads to an edge **32*a* adjacent the beam 19. The beveled edge 32*a* leads across the slide plate to beveled corners 33. The beveled surface 32 and corners 33** are useful to avoid crushing contact with user's fingers as the blade is moved back and forth along the length of the beam. Fingers in the path of the beveled surfaces will likely be cammed aside by the inclined surfaces as the slide plate moves toward the platform during splitting operations.

Figures 6, 7:
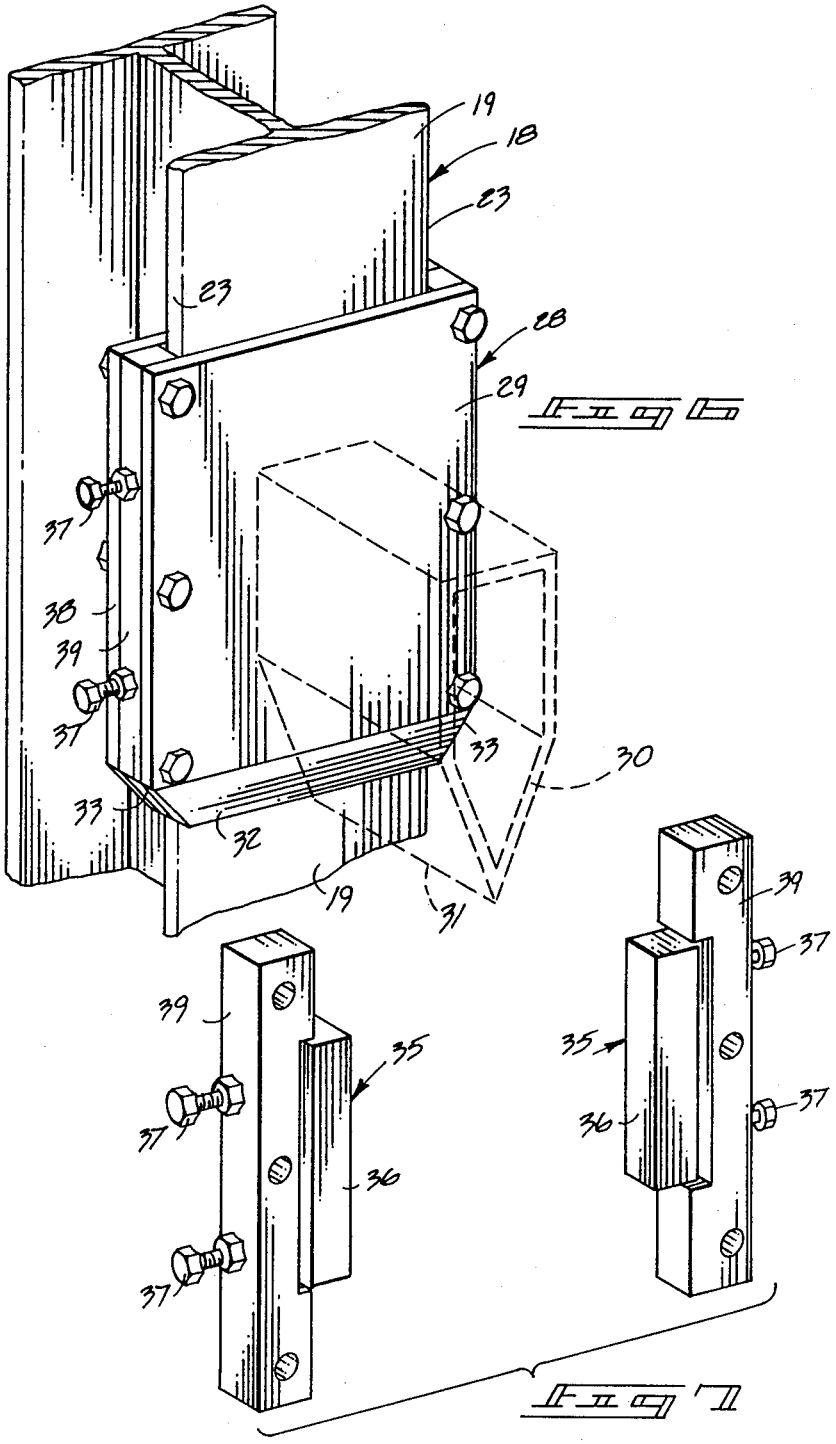
FIG. 6 is a fragmented view illustrating the splitter beam and portions of the slide plate of the present portable splitter.
FIG. 7 is a pictorial view detailing gibs for the slide plate shown in FIG. 6.

Gib means 35 is provided on the slide plate to slidably engage the beam side edges 23 for movably guiding the blade along the length of the beam 19. The gib means is comprised of a pair of gib plates 36 as shown in FIG. 7. These plates 36 are sandwiched between the slide plate 29 and flanges 38 by spacers 39. The plate 29, flanges 38, and spacers 39 are secured together by bolts 37. Adjusting bolts 37 extend through the spacers 39 to engage the gib plates 36. Bolts 37 may threadably engage the spacers so bolt rotation will cause corresponding motion of the gib plates toward or away from sliding engagement with the beam edges 23. The double gib arrangement will facilitate adjustments to compensate for wear along the gibs and beam side edges 23. The gibs additionally facilitate centering of the blade across the beam 19 to avoid binding forces that could otherwise confronted if the blade were allowed to be shifted toward one side edge 23 to compensate for wear.

In the examples shown the blade assembly is attached to the ram section of a cylinder 26. The cylinder 26, in turn, is mounted by a bracket 25 to the beam 19. The cylinder is preferably hydraulic, driven by a motor or engine and hydraulic pump assembly 90 to forcibly move the blade 30 along the beam.

A blade guard and wood stripper 49 is provided on the cylinder 26 to encase the blade 30 adjacent the cylinder end. The blade guard and stripper includes lower edge surfaces **49*a*** spaced to opposite sides of the blade edge for stripping wood from the blade as the cylinder is retracted. The blade guard and stripper are similar to the bladeguard and stripping mechanisms disclosed in my U.S. Pat. No. 4,700,759 which is hereby incorporated by reference in the present application.

Figure 1:
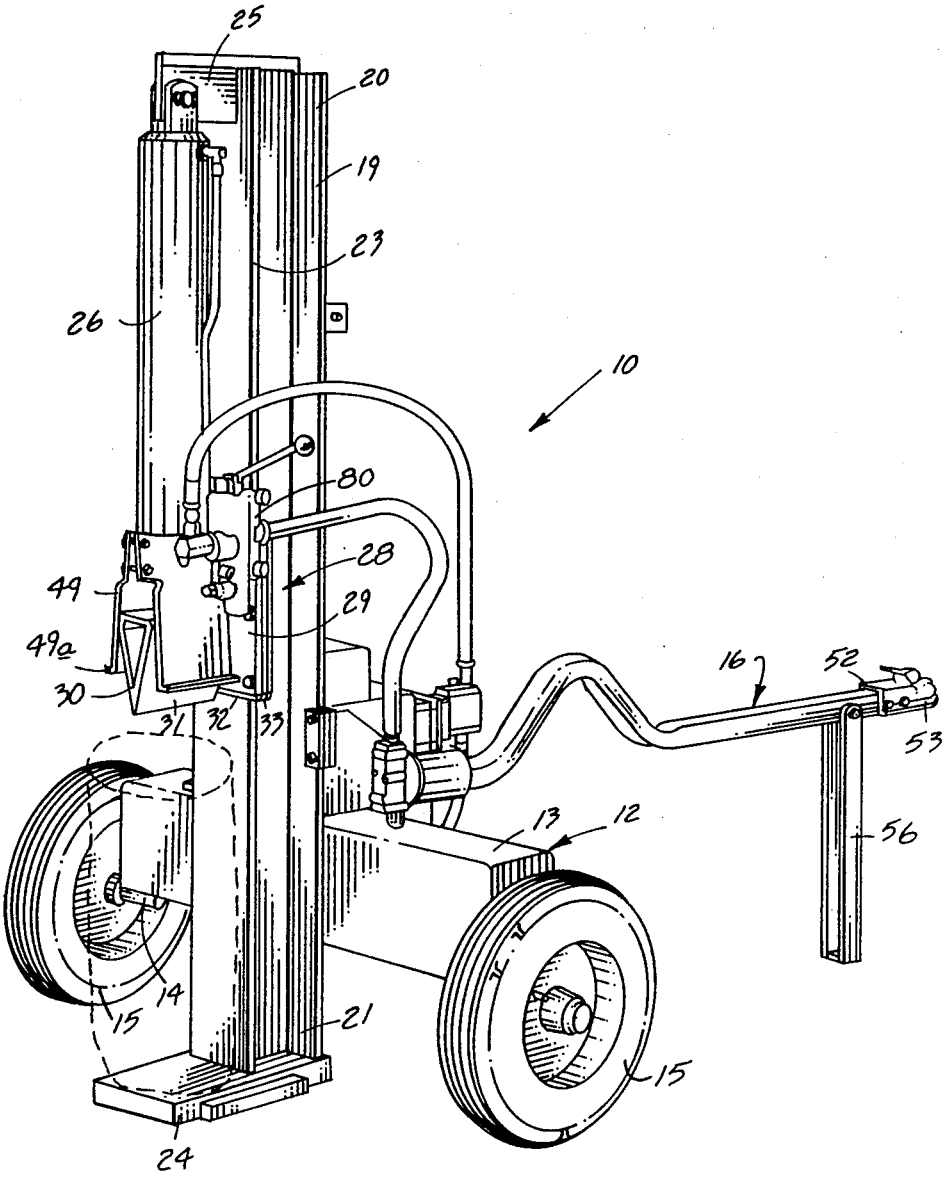
FIG. 1 is a pictorial view of the present portable splitter with the splitting frame in an upright substantially vertical orientation.
Figure 2:
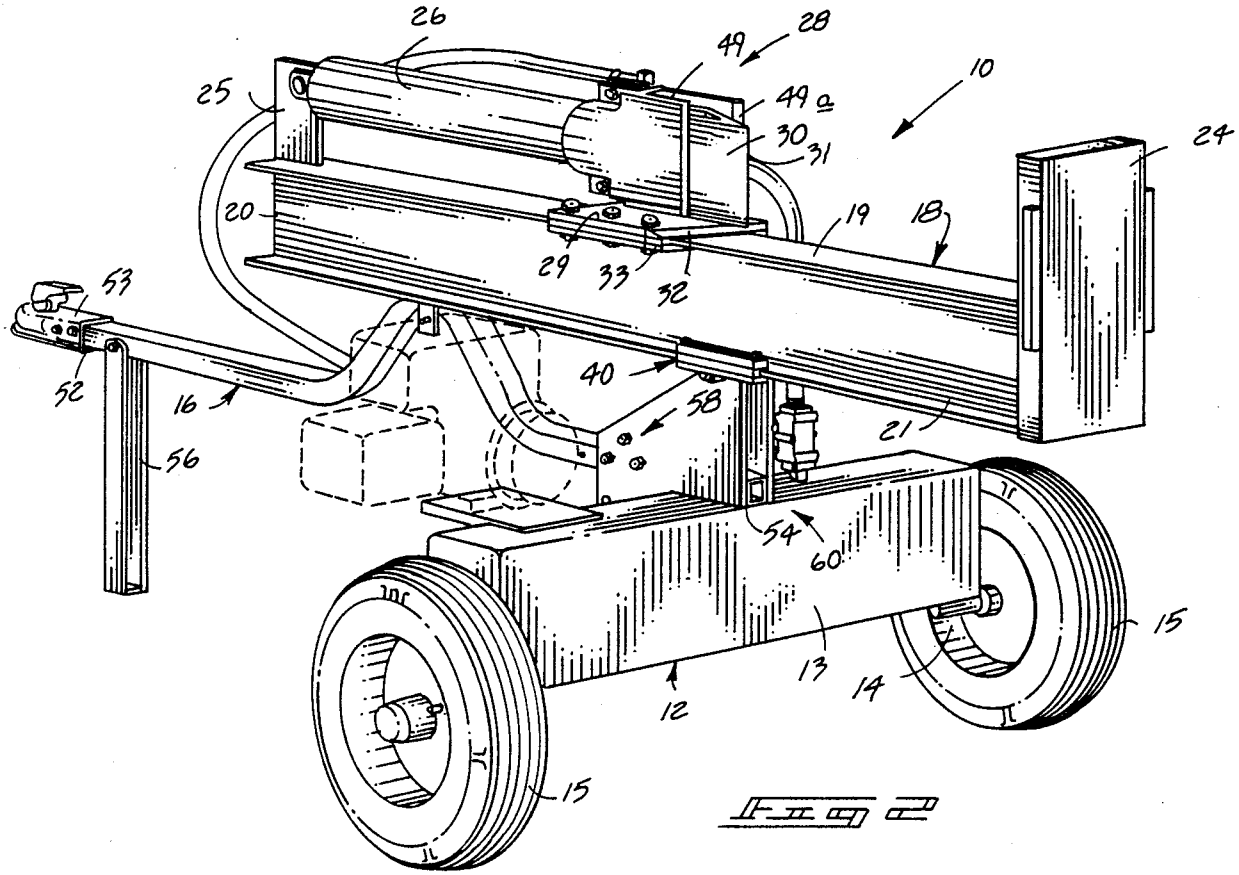
FIG. 2 is a pictorial view of the present splitter with the splitting frame in a substantially horizontal orientation.
Figure 3:
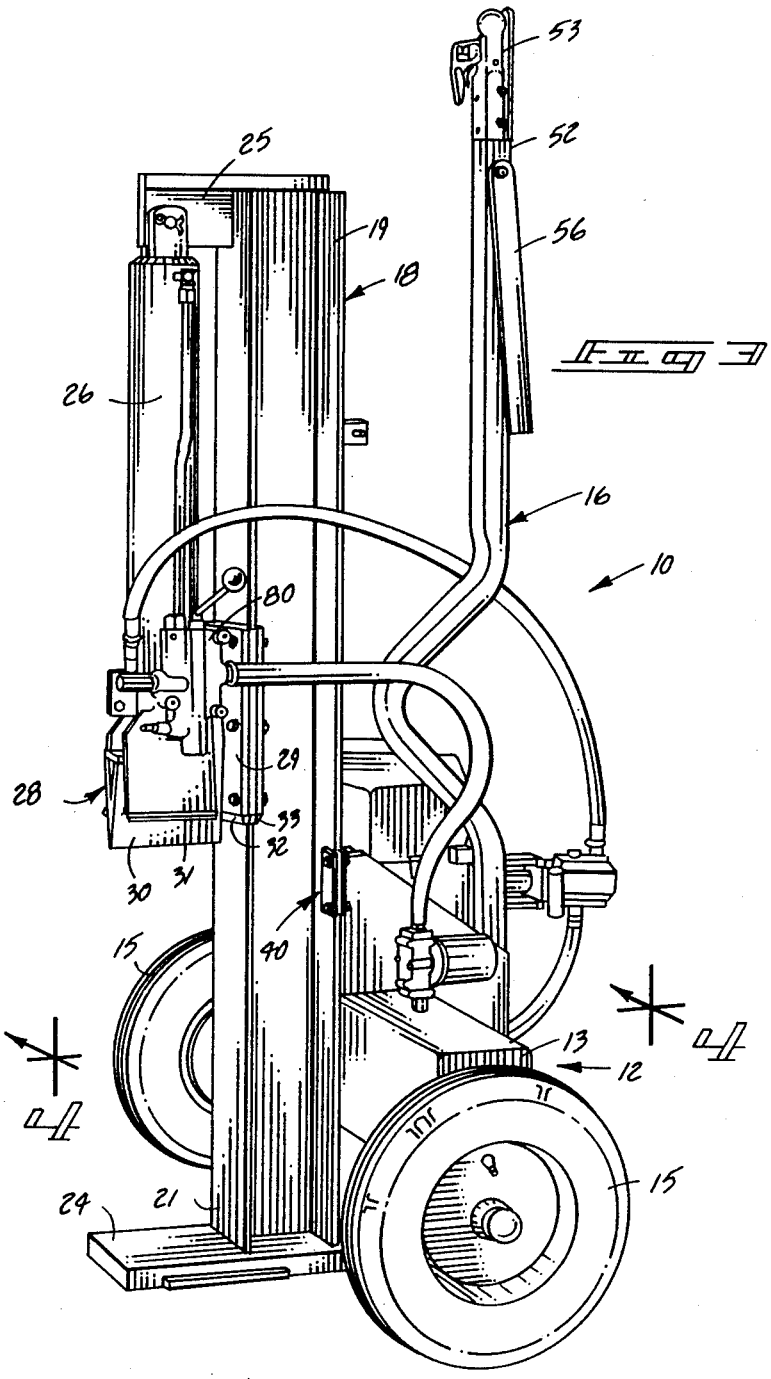
FIG. 3 is a pictorial view of the present portable splitter with the splitting frame and tongue in upright, storage positions.

Means 40 is provided between the wheeled frame 12 and the splitter frame 18 for pivotably mounting the splitter frame for movement between the horizontal condition illustrated in FIG. 2 and the vertical condition illustrated in FIGS. 1 and 3. Means 40 includes hinge assembly that facilitates such pivotal motion. More particularly, the means 40 may include a plate 41 secured to the beam 19 by spacers 43 and clamp plates 44. Conventional bolt and nut assemblies 42 are utilized to selectively clamp the plate 41 and plates 44 to the beam in order to secure the beam to the wheeled frame 12 in stationary relation along its length. The bolt and nut assemblies 42 can also be selectively loosened to facilitate longitudinal adjustment of the beam along its length.

The hinge is comprised of a first hinge leaf 45 that is secured to the plate 41. A complimentary second hinge leaf 46 is secured to a bracket 48 on the wheel frame 12. The hinge leaves 45, 46 interfit, along with a hinge pin 47 to permit pivotal motion of the splitter frame between the positions shown.

The towing tongue 16 extends between a forward end 52 and a rearward end 54. A hitch connector 53 is provided at the forward end 52. A pivoted brace 56 is provided adjacent the hitch connector 53 on the towing tongue. Brace 56 may be operatively shifted between the operative support position illustrated in FIGS. 1 and 2 and a storage position illustrated in FIG. 3. In the operative position, the brace extends downwardly from the tongue to engage the ground surface to stabilize the splitter. The brace can be pivoted against the tongue 16 to minimize the storage space requirements for the entire unit.

Figure 5:
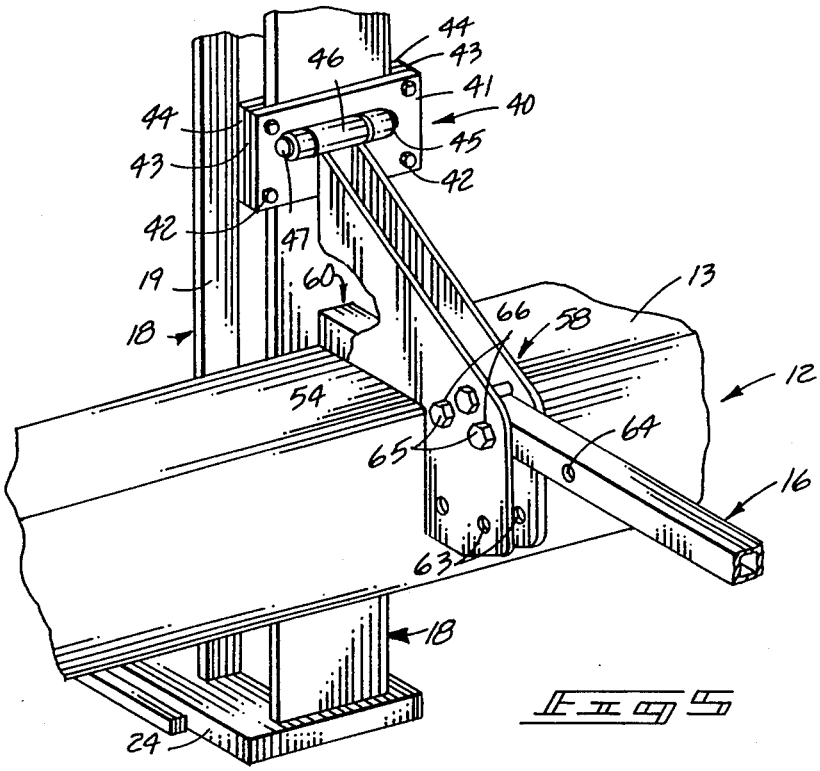
FIG. 5 is a fragmented pictorial view.
Figure 4:
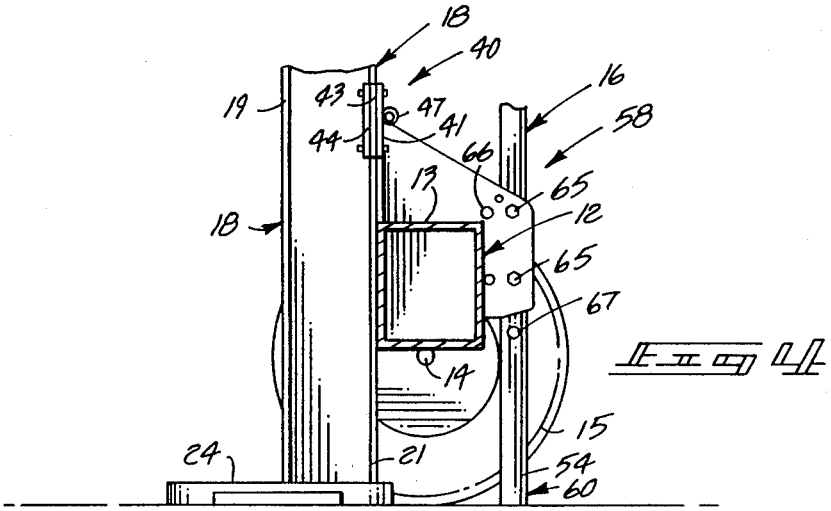
FIG. 4 is a fragmented sectional view taken substantially along line 4—4 in FIG. 3.

An adjustment means 58 is provided between the towing tongue 16 and the frame member 13. Means 58 permits selective positioning of the tongue 16 between the substantially horizontal operative position shown in FIGS. 1 and 2 and an upright storage position as shown in FIG. 3. The adjustment means 58 includes a pair of mounting holes 63 on the bracket 48 and a complimentary set of mounting holes 64 on the tongue 16. Bolt and nut assembly 65 are received through aligned sets of holes 63, 64 to secure the tongue and frame member in the upright orientation as shown in FIG. 4. Another set of mounting holes 66 are provided on the bracket, to align with a second set of mounting holes 67 on the tongue in order to secure the tongue in its horizontal position as shown in FIG. 5. The bolt-nut assemblies 65 and several sets of mounting holes also function as lock means for securing the tongue in either the upright or the horizontal position thereof.

The towing tongue 16 preferably includes a ground engaging means 60 at the rearward tongue end for engaging the ground surface when the tongue is mounted in its upright orientation. Ground engaging means 60 may be an integral surface at the rearward end of the tongue or conceivably could be a foot or platform attachment somewhat similar to the platform 24. Ground-engaging means 60 is utilized to stabilize the splitter in its upright storage orientation as shown in FIGS. 3, 4. When operative, the ground engaging means 60 completes a spaced four point ground contact, along with the two wheels 15 and the platform 24 to stabilize the entire splitter in its upright storage orientation.

The first preferred form of the present splitter is connected to a towing vehicle when the splitter frame 18 and towing tongue 16 are situated in the horizontal position illustrated in FIG. 2. This position will serve as a reference or starting point for the following description of the operation of the present invention.

Connection between the conventional hitch connector 53 and an appropriate connector (not shown) on a towing vehicle is made in the usual manner. The splitter is then transportable to a selected site for operation. The splitter and tongue are carried in a low profile to maximize visibility and to maintain a low center of gravity for transport.

At the site, the brace member 56 is pivoted downwardly to its operative position and the hitch connector is removed. Alternatively, the hitch connector may remain engaged with the mating connector on the towing vehicle if so desired.

Operation may commence with the splitter frame situated in the horizontal position if so desired. However, if large blocks of wood are being split, it may be more desirable to move the splitter frame to the upright orientation. The user may pivot the splitter frame 18 to its upright orientation simply by unlatching the splitter frame from the tongue 51 and lifting the splitter frame upwardly.

Once the splitter frame is in the vertical operative orientation, splitting may commence or additional elevational adjustments of the beam 19 may be initiated by operation of the adjustment means 40. Adjustment means 40 is utilized to allow the splitter frame 18 to be adjusted elevationally such that the bottom beam end 21 or platform 24 may rest firmly against the ground surface if it does not already do so.

Whether or not the beam will automatically pivot to a position where the platform will engage the ground surface depends upon the ground terrain. If either or both of the wheels 15 rest on higher ground than the area just below the platform 24, adjustment may be necessary to establish contact between the platform and the ground surface in order to maintain the stable vertical relationship of the beam. This is done simply by loosening the bolt and nut assemblies 42 thereby allowing the beam 19 to slip elevationally downward until the platform 24 comes into contact against the ground surface. Bolt and nut assemblies 42 may now be tightened again to secure the beam to the remainder of the wheeled frame.

Similar adjustment may be made with the clamp plates when the beam is in the horizontal operative position. This is done when it is desired to shift the weight of the beam in relation to the three point ground contact between wheels 15 and the vehicle hitch connector or pivoted brace 56. The drive motor and pump assembly 90 may be started after the splitter is set up and secure on the ground surface.

During splitting, the control valving mechanism 80 is utilized to direct fluid to the cylinder 26 causing relative motion between the blade 30 and platform 24 to force the blade against a wood block positioned between the platform and blade. The cylinder will drive the blade through the wood, causing it to split. The valve mechanism 80 may then be actuated to retract the cylinder, pulling the blade back to its starting position.

During the above motions, the slide plate 29 slides relatively freely over the beam 19 due to the central positioning of the blade by provision of the gib plates 36. These plates can be adjusted to substantially center the blade edge in relation to the axis for the cylinder and the center of the beam 19. Thus centered, the blade will not produce undesired lateral binding forces on the slide plate and gibs that would otherwise detract from the splitting force applied by the cylinder.

On rare occasions the user's fingers may be unintentionally placed on a block in the downward path of the slide plate 23. The fingers may be engaged by the beveled surfaces 32 or 33 as the blade is driven toward the platform. The descending surfaces 32 or 33 may then cam or push the misplaced fingers safely aside.

The splitter frame 18 may be pivoted back to the horizontal position after the splitting operation to facilitate transport back to a storage area. The steps for shifting the splitter frame back to the horizontal orientation simply involves pulling the platform rearwardly and downwardly from the top frame end 20. The beam 19 will pivot about the axis of the hinge and swing easily to the horizontal transport condition. The beam can then be latched appropriately to the towing tongue 16, the brace 56 can be shifted to its inoperative position, and the entire unit can be towed to a convenient storage area.

To place the unit proper condition for storage, occupying minimal floor space, it may be desired to shift the beam to its upright orientation. Following this step, the towing tongue 16 may be removed and placed in its upright storage condition. This is done simply by removing the mounting bolts 65 and shifting the towing tongue to the upright position in relation to the bracket 48 by aligning the mounting holes 64 with the bracket mounting holes 63. By doing so, the bottom ground engaging surface of the tongue is automatically positioned at the plane of the floor or other support surface (FIGS. 2 and 4) such that four point contact is established between the ground engaging means 60, the two wheels 15 and the splitter platform 24. The tongue 16 is thereby pivoted out of the way to minimize storage space requirements. Additionally, the ground engaging means 60 functions in this position to stabilize the entire unit to prevent inadvertent tipping of the splitter while in storage.

The portable splitter embodiment illustrated in FIG. 8 includes a support frame 70 that is particularly adapted for attachment to a tractor or similar vehicle 73. The support frame 70 is substantially rigid, in the form of an inverted "U" configuration. It includes three point hitch mounts 71 positioned along the frame 70 for connection to a complimentary three point hitch members 72 on the tractor 73.

A clamp means 74 is provided to secure the splitter frame 18 to the support frame 70. Clamp means 74 includes a plate 75 that is secured in stationary relation to the support frame 70. Clamp plates 76 are mounted by bolt and nut assembly 77 to the plate 75. The bolt and nut arrangements 77 may be selectively loosened to facilitate elevational adjustment of the splitter frame 18 in relation to the support frame 70.

The clamp means 74 enables mounting of the present device to different tractors with three point hitch asemblies having different elevations in their lowered positions. The clamp means 74 facilitates elevational adjustment of the splitter frame to the tractor hitch elevation while the splitter platform 24 remains on the ground. This feature facilitates mounting and dismounting of the splitter to the same tractor once initial adjustments have been made.

The second embodiment splitter may be stored by using the support frame as a stabilizing frame when the entire unit is dismounted from the tractor. Bottom ends 79 of the inverted "U" shaped frame will then rest against the ground surface and stabilize the platform 24 which also rests against the ground surface. This is accommodated by the clamp means 74 which enables elevational adjustment of the support frame relative to the splitter frame and platform.

Attachment of the second embodiment to a tractor may be accomplished simply by loosening the bolt assemblies 77 and elevationally adjusting the support frame 70 to match the elevational position of the three point hitch members on the tractor. The tractor can then be positioned to receive the three point hitch mounts 71. The appropriate connections are then made, securing the hitch mounts 71 to the tractor members 72, thereby securing the frame to the tractor. Next, the bolt assemblies 77 may be secured to securely clamp the splitter frame 18 to the support frame 70. Upon accomplishing this step, the frame and splitter frame are rigidly connected together and the three point hitch assembly of the tractor can be operated to raise or lower the splitter for transport.

Splitting may occur following connection of the cylinder 26 to an appropriate conventional source of pressurized fluid (not shown). In the second embodiment, the source of pressurized fluid may be a conventional source supplied with the tractor. However, it is conceivable that a separate source including an appropriate pump and engine (not shown) may be supplied along with the splitter components shown. Operation may commence once the pressurized fluid is supplied by selective operation of the appropriate conventional valving mechanisms 80 which, responsive to positioning of a control lever, directs fluid to the cylinder 26 causing it to extend and drive the splitting blade 30 toward the platform 24 or retract and pull the splitting blade back away from the platform 24.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

What is claimed is:

1. A portable wood splitter, comprising:

a ground supported wheeled frame;

a splitter frame mounted to the wheeled frame for pivotal movement about a pivot axis between a substantially horizontal orientation and a substantially upright orientation;

means on the wood splitter frame for splitting wood;

a towing tongue having a forward end with a hitch connector thereon, and a rearward end;

adjustment means mounting the towing tongue to the wheeled frame for selective positioning between a first position wherein the towing tongue is in a substantially horizontal towing orientation and a second position wherein the towing tongue is in a substantially upright storage orientation; and ground engaging means for ground contact to stabilize the splitter frame and towing tongue in their upright orientations.

2. The portable wood splitter of claim 1 further comprising lock means for releasably securing the towing tongue in either the first or the second position thereof.

3. The portable wood splitter of claim 1 wherein the ground engaging means is integral with the towing tongue and is situated at the rearward end of the towing tongue opposite the forward end thereof.

4. The portable wood splitter of claim 1 wherein the splitter head includes:

a beam;

a platform member on the beam for engaging a wood block at a first block end;

a splitting blade member on the frame and having a blade edge for engaging a wood block at a second block end opposite the first block end;

a slide plate mounting one of the members to the beam for movement thereon toward and away from the remaining member; and gib means on opposite sides of the slide plate adjustably positionable against the beam to slidably engage the beam and slidably guide the slide plate along the beam length.

5. The portable wood splitter of claim 4 wherein the slide plate includes a beveled surface leading to an edge adjacent the beam.

6. The portable wood splitter of claim 1 wherein the splitter frame includes an elongated rigid beam and wherein splitter head includes a slide plate mounted to the beam and mounting a splitting blade for sliding motion on the beam toward and away from the platform and wherein the slide plate includes a beveled edge substantially facing the platform.

7. The portable wood splitter of claim 1 wherein the wheeled frame mounts a pair of ground engaging wheels;

wherein the splitter frame includes a fixed platform at an end thereof for engagement with the ground surface to one side of the wheels when the splitter frame is in its upright position; and wherein the ground engaging means contacts the ground surface to a side of the wheels opposite the one side when the towing tongue is in the second position such that a spaced four point contact may be established with the ground surface by the pair of wheels, the fixed platform and the ground engaging means.

8. The portable wood splitter of claim 7 further comprising:

means for adjustably positioning the splitter frame relative to the wheeled frame and wheels.

9. The portable wood splitter of claim 7 wherein the ground engaging means is integral with the towing tongue and is situated at the rearward end thereof.

10. The portable wood splitter of claim 9 wherein the splitter frame includes:

an elongated beam having a top end and a bottom end;

a fixed platform on the bottom end of the beam;

a slide plate mounted to the beam for movement along the length thereof, toward and away from the platform;

a splitting blade on the slide plate with a cutting edge facing the platform; and wherein the slide plate includes a beveled surface leading to an edge adjacent the beam.

11. The portable wood splitter of claim 10 further comprising gib means on the slide plate adjustably positionable against the beam to slidably center the cutting edge transversely in relation to the elongated beam.

12. The portable wood splitter of claim 1 wherein the adjustment means is comprised of:

a bolt assembly interconnecting the towing tongue to the splitter frame in the first and second positions.

13. The portable wood splitter of claim 12 wherein the bolt assembly is comprised of a pair of removable bolts extending through the towing tongue and the splitter frame when in the first position.

14. The portable wood splitter of claim 12 wherein the pair of bolts includes a forward bolt that extends through the towing tongue and splitter frame when the tongue is in the first and second positions.

15. The portable wood splitter of claim 1 wherein the ground engaging means is integral with the towing tongue.

16. The portable wood splitter of claim 15 wherein the ground engaging means is held above the ground surface when the towing tongue is in the first position, and engages the ground surface when the towing tongue is in the second position.

17. The portable wood splitter of claim 1 wherein the ground engaging means is comprised of a surface on the towing tongue at the rearward end thereof for stabilizing the portable wood splitter when the towing tongue is in the second position.

* * * * *

UNITED STATES PATENT AND TRADEMARK OFFICE

CERTIFICATE OF CORRECTION

PATENT NO. : 4,782,870

DATED : November 8, 1988

INVENTOR(S) : Dennis Duerr

It is certified that error appears in the above-identified patent and that said Letters Patent is hereby corrected as shown below:

On cover page under heading "OTHER PUBLICATIONS" add - - Publication: advertisement, "Splitting Bull" - -

In claim 1, column 8, line 4 add - - independent of and separate from the splitter frame, - - after the word "tongue"

In claim 1, column 8, line 7 add - - the towing tongue independently of the pivotal movement of the splitter frame, - - after the word "positioning".

In claim 4, column 8, line 24 change "head" to - - frame - - .

In claim 7, column 8, line 47 change "1" to - - 3 - -.

In claim 7, column 8, line 55 add - - fixed platform and the - - after "opposite the".

In claim 9, column 8, line 65 change "7" to - - 2 - -.

After claim 17, column 10 add

- - 18. A portable wood splitter, comprising:

a ground supported wheeled frame;

a splitter frame including thereon a wood support platform at splitter frame one end and means for splitting wood against the platform;

UNITED STATES PATENT AND TRADEMARK OFFICE

CERTIFICATE OF CORRECTION

PATENT NO. : 4,782,870

DATED : November 8, 1988

INVENTOR(S) : Dennis Duerr

It is certified that error appears in the above-identified patent and that said Letters Patent is hereby corrected as shown below:

a hinge mounting the splitter frame to the ground supported wheeled frame for pivotal movement thereon between a substantially horizontal orientation with the platform carried above the ground surface and a substantially upright orientation with the platform positioned to rest upon the ground surface to one side of the ground supported wheeled frame;

a towing tongue independent of the splitter frame and including a forward end with a hitch connector thereon and a rearward end;

adjustment means mounting the towing tongue to the wheeled frame independent of and separate from the hinge for selectively positioning the towing tongue between a (a) first position wherein the towing tongue is in a substantially horizontal towing orientation underlying and spaced from the splitter frame when in its horizontal orientation and wherein the towing tongue may remain in its first horizontal position independent of movement of the splitter frame to its upright

UNITED STATES PATENT AND TRADEMARK OFFICE

CERTIFICATE OF CORRECTION

PATENT NO. : 4,782,870

DATED : November 8, 1988

INVENTOR(S) : Dennis Duerr

It is certified that error appears in the above-identified patent and that said Letters Patent is hereby corrected as shown below:

orientation, and (b) a second position, when the splitter frame is in its upright orientation, wherein the towing tongue is in a substantially upright storage orientation with the ground engaging means positioned to rest upon the ground surface to a side of the ground supported wheeled frame opposite the one side;

ground engaging means on the towing tongue at the rearward end for engaging the ground surface when the towing tongue is in its upright orientation; and

UNITED STATES PATENT AND TRADEMARK OFFICE

CERTIFICATE OF CORRECTION

PATENT NO. : 4,782,870

DATED : November 8, 1988

INVENTOR(S) : Dennis Duerr

It is certified that error appears in the above-identified patent and that said Letters Patent is hereby corrected as shown below:

lock means for releasably securing the towing tongue in either the first or the second position independently of the splitter frame. - -

Signed and Sealed this

Eighteenth Day of April, 1989

*Attest:*

DONALD J. QUIGG

*Attesting Officer*

*Commissioner of Patents and Trademarks*